US008869461B1

(12) United States Patent
Ferry et al.

(10) Patent No.: US 8,869,461 B1
(45) Date of Patent: Oct. 28, 2014

(54) STADIUM SEATING SYSTEM WITH IMPROVED CONCRETE TREAD PANEL DESIGN

(71) Applicant: Dant Clayton Corporation, Louisville, KY (US)

(72) Inventors: Jason Ferry, Louisville, KY (US); Roger Ray, Louisville, KY (US); Jared Hinton, Louisville, KY (US); Brian DeHart, Louisville, KY (US)

(73) Assignee: Dant Clayton Corporation, Louisville, KY (US)

( * ) Notice: Subject to any disclaimer, the term of this patent is extended or adjusted under 35 U.S.C. 154(b) by 0 days.

(21) Appl. No.: 13/945,081

(22) Filed: Jul. 18, 2013

(51) Int. Cl.
*E04H 3/12* (2006.01)
*E04F 11/00* (2006.01)

(52) U.S. Cl.
CPC ..... *E04H 3/12* (2013.01)
USPC ..... 52/8; 52/189; 52/188

(58) Field of Classification Search
CPC ..... E04B 1/4107; E04B 1/41; E04B 1/4157; E04H 3/12; E04F 2011/0212; E04F 2011/0214; E04F 11/035; E04F 11/025; E04F 11/09; E04F 11/116
USPC ..... 52/8, 182, 184, 188, 189, 190, 191
See application file for complete search history.

(56) References Cited

U.S. PATENT DOCUMENTS 894,801 A * 7/1908 Schachner ..... 52/184
1,353,377 A 9/1920 Bois
1,412,788 A 4/1922 Lehman
1,452,467 A 4/1923 Lambert
1,457,515 A 6/1923 Frisch
1,565,680 A 12/1925 Manton
1,593,360 A 7/1926 Richmond at al.
1,679,570 A 8/1928 Hall
1,771,405 A 7/1930 Felsenthal
1,789,969 A 1/1931 Davis
1,792,792 A 2/1931 Woodbridge
1,835,759 A 12/1931 Cook
1,870,598 A * 8/1932 Amann ..... 52/184
1,965,486 A 7/1934 Cannon
2,155,908 A * 4/1939 Samonds ..... 249/14
2,205,859 A 6/1940 O'Donnell
2,466,982 A 4/1949 Easterwood
2,555,002 A 5/1951 Philips at al.

(Continued)

FOREIGN PATENT DOCUMENTS

JP 06307044 A 11/1994

*Primary Examiner* — Brent W Herring
(74) *Attorney, Agent, or Firm* — Woodard, Emhardt, Moriarty, McNett & Henry LLP

(57) ABSTRACT

A stadium and arena seating system is provided which preferably utilizes pre-cast concrete tread surfaces and metallic or other non-concrete vertical risers therebetween. The pre-cast concrete treads have non-concrete front embeds embedded within the front of the treads respectively, and an integrally formed upwardly extending concrete lip portion for shedding water from the upper adjacent riser that eliminates the need for a non-concrete rear embed. The front embeds may comprise a metallic or other non-concrete material similar to the vertical risers. The vertical risers are arranged in a shingled fashion overlapping the upwardly extending concrete lip portion of the treads to provide water and debris shedding. In a further aspect, the upwardly extending concrete lip portion may optionally be formed with a plurality of pre-formed mounting holes through which fasteners for fastening a lower portion of the riser may be received.

4 Claims, 4 Drawing Sheets

(56) References Cited

U.S. PATENT DOCUMENTS

| | | | | | |
|---|---|---|---|---|---|
| 2,703,005 | A | * | 3/1955 | Dobermann | 52/189 |
| 2,817,389 | A | | 12/1957 | Richards | |
| 2,929,703 | A | | 8/1960 | Katzmarek | |
| 2,949,703 | A | * | 8/1960 | Katzmarek | 52/188 |
| 3,099,336 | A | | 7/1963 | Hawkins | |
| 3,257,761 | A | | 6/1966 | Klein | |
| 3,875,708 | A | * | 4/1975 | Thorsnes | 52/189 |
| 3,981,112 | A | * | 9/1976 | Dake | 52/184 |
| 4,244,154 | A | | 1/1981 | Weaver | |
| 4,790,594 | A | | 12/1988 | Temos | |
| 4,893,442 | A | | 1/1990 | Graham et al. | |
| 5,014,475 | A | | 5/1991 | Anderson, Jr. et al. | |
| 5,159,788 | A | | 11/1992 | Merrick | |
| 5,511,347 | A | | 4/1996 | Schwarz | |
| 5,660,009 | A | | 8/1997 | Cousin | |
| 5,960,589 | A | | 10/1999 | Youngquist et al. | |
| 6,474,024 | B1 | | 11/2002 | MacIntyre | |
| 6,733,082 | B1 | | 5/2004 | Treon | |
| 6,922,947 | B2 | | 8/2005 | Jines et al. | |
| 7,047,699 | B2 | | 5/2006 | Kennedy | |
| 7,073,858 | B2 | | 7/2006 | Fisher et al. | |
| 7,617,652 | B1 | | 11/2009 | Flatmoe | |
| 7,905,060 | B2 | | 3/2011 | Brunner | |
| 8,266,842 | B2 | | 9/2012 | Merrick et al. | |
| 2004/0020142 | A1 | | 2/2004 | Kress | |
| 2006/0150540 | A1 | | 7/2006 | Kennedy | |
| 2009/0151275 | A1 | | 6/2009 | Naccarato et al. | |
| 2009/0272042 | A1 | | 11/2009 | Brunner | |
| 2011/0277390 | A1 | * | 11/2011 | Merrick et al. | 52/8 |

* cited by examiner

STADIUM SEATING SYSTEM WITH IMPROVED CONCRETE TREAD PANEL DESIGN

FIELD OF THE INVENTION

Embodiments of the present invention deal with stadium and arena seating systems, and in particular to seating systems which utilize a hybrid composition understructure having a combination of concrete and non-concrete support components.

BACKGROUND

The grandstand, stadium and arena seating industry has traditionally relied on two main types of construction to provide adequate walking surfaces, or treads, and associated riser surfaces therebetween. The first of these is a reinforced concrete system utilizing concrete for both the horizontal tread and vertical riser portions. Concrete provides excellent performance in relation to vibration, noise transfer, and deflection. However, concrete also has its drawbacks. For example, in a typical concrete system, two or three row precast pieces spanning twenty to fifty feet are poured at the factory and shipped to the jobsite for installation. The pieces include very thick reinforced concrete treads and risers. Caulk must then be used to seal the horizontal joints where the precast pieces meet and prevent water seepage. The forms needed to pour these pieces are fairly expensive and typically cannot be reused from one project to the next due to custom configurations in the seating bowl. Some systems utilize concrete treads which are poured on site, which causes other concerns regarding the unpredictability of jobsite temperature and humidity conditions in addition to the added cost of on-site concrete pouring equipment.

In addition, an all-concrete system requires that epoxy or expansion anchors be used to attach the seats or benches to the concrete treads and risers, a process that typically requires expensive field drilling and time for the epoxy to cure. The concrete system is also extremely heavy and difficult to install and requires a stronger steel or concrete understructure for support.

The other type of construction commonly used involves metallic treads and risers, often aluminum, supported by a steel understructure. The aluminum treads typically span only about six feet, and are typically supported by steel stringers positioned on six foot centers. The aluminum system provides more cost effective options for installation, final adjustment, and seat mounting, although typically cannot match the performance characteristics of the concrete system. Aluminum systems also offer more options in terms of vertical surface coloring and may be more easily modified on a project to project basis.

An improved alternative which offers some advantages of both above previously described constructions is disclosed in applicant's prior U.S. Pat. No. 8,266,842 entitled "Stadium Seating Construction" issued Sep. 18, 2012, the disclosure of which is fully incorporated by reference herein for all purposes. This patent generally discloses a stadium seating system having a hybrid support understructure which includes a combination of concrete and non-concrete support components. The present invention provides an alternative enhancement of this design which provides advantages as herein described.

SUMMARY

According to one aspect, an improved stadium seating system is disclosed. The system comprises a tiered support understructure, a plurality of tiered concrete treads, and a plurality of tiered risers. The treads are mounted to the stadium seating support understructure and have a pre-cast concrete body portion, and a non-concrete front embed embedded within a front end of the concrete body portion. The front embeds and risers may be formed from a non-concrete material such as metal, plastic, or fiberglass.

According to another aspect, the pre-cast concrete body portion includes an integrally formed upwardly extending lip portion for shedding water from the upper adjacent riser and that eliminates the need for a rear embed, thus providing a significant cost savings.

According to another further aspect, the upwardly extending lip portion may optionally be formed with a plurality of pre-formed mounting holes through which fasteners for fastening a lower portion of the riser which overlaps with a forward side of the upwardly extending portion may be received.

Additional embodiments, as well as features and advantages thereof, will be apparent to those of ordinary skilled in the art from the descriptions herein.

DESCRIPTION OF THE SELECTED EMBODIMENTS

Figure 1:
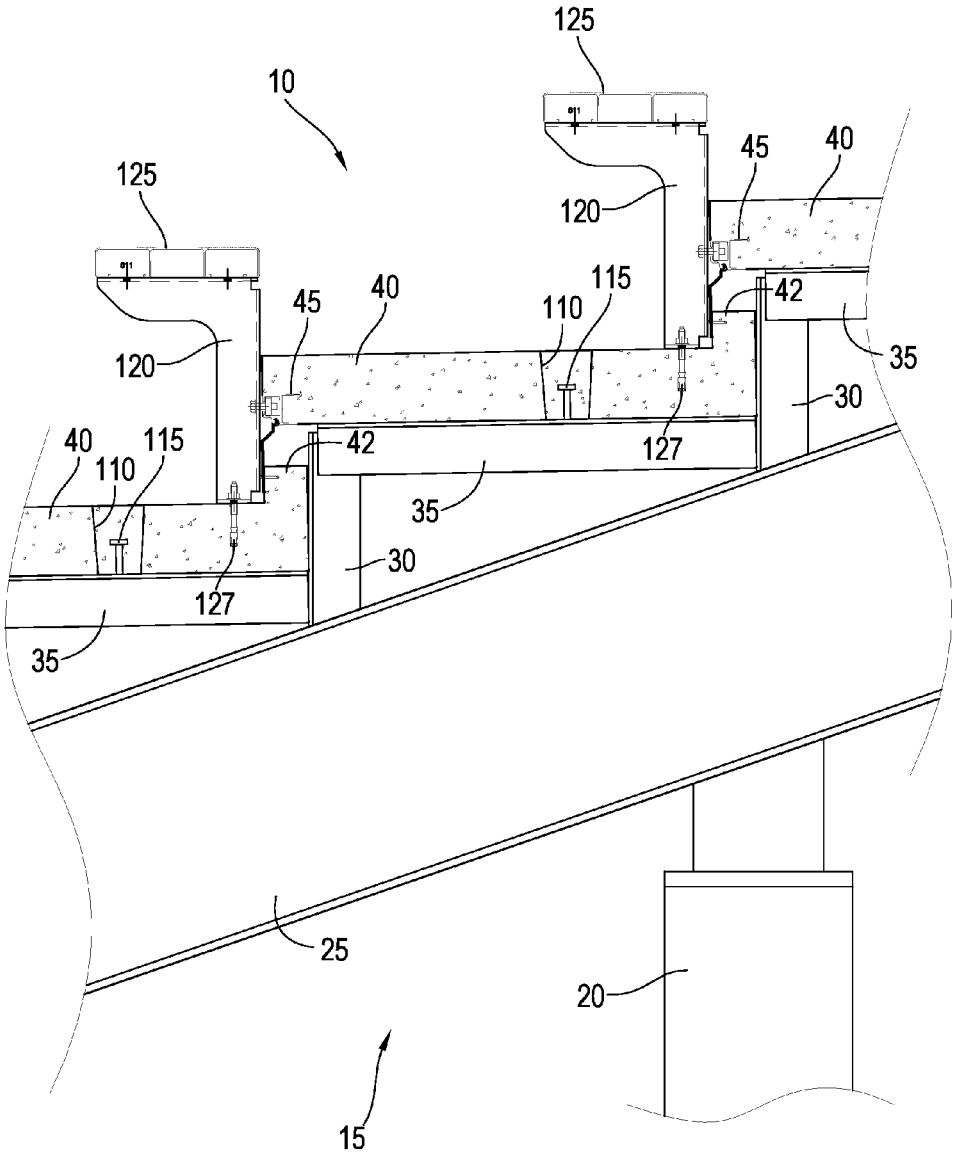
FIG. 1 is a side view of a hybrid stadium seating system having concrete treads with non-concrete front embeds according to one embodiment of the present disclosure.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

As used in the claims and specification, the term "stadium seating" refers to any tiered structure built to provide seating or standing accommodations for spectators at a sporting or other public or private event.

As used in the claims and specification, the term "seat" refers to chairs, benches or any structure upon which a person may sit and intended for use in a stadium seating structure.

FIG. 1 shows a side view of a stadium seating construction system 10 according to one embodiment of the present disclosure. One illustrative example of a suitable support understructure 15 is depicted in FIG. 1 and includes main support beams 20 and stringers 25, which support tiered riser supports 30 and runner supports 35. It should be understood that many various other designs for the support understructure 15 may also be accommodated for use in system 10 such as are known in the art and components thereof such as for example runner supports 35 are optional and could be modified or dispensed with entirely if desired. The various understructure components may be attached using any fastening method known in the art including, but not limited to, welding, riveting and bolting. It shall be understood that the cross-sectional geometry of the understructure components may include I-beams, "L" beams, "T" beams, cylindrical columns or any other support geometry known in the art. It shall be further understood that support understructure 15 may comprise additional metallic or concrete structural components to achieve the support requirements of the given application.

In a preferred embodiment, floor treads 40 are placed on top of runner supports 35 such that multiple runner supports 35 are supporting each tread 40. The treads 40 are preferably comprised of individual concrete sections, each with a span of approximately six feet, although the span may be adjusted to be shorter or longer (such as for one further illustrative example, eight feet) depending on the application requirements. In a preferred embodiment, the treads 40 will be precast in a controlled factory environment before being delivered to the jobsite, although cast-in-place concrete may be used as well. Pre-cast treads are also easier to install and typically provide greater strength in relation to an equal size cast-in-place unit. The reduced span length also eliminates the need for prestressing.

Figure 3:
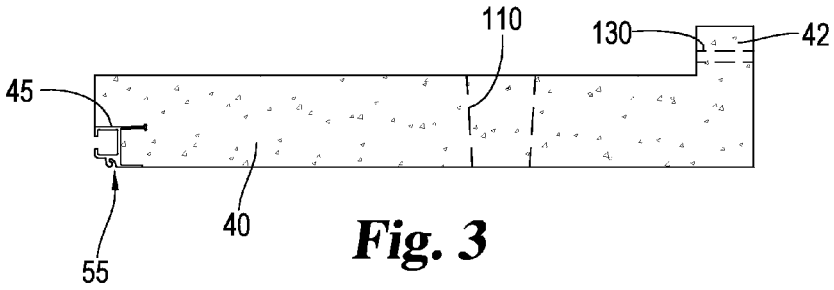
FIG. 3 is a side view of a concrete tread with a front embed according to one embodiment of the present disclosure.
Figure 4:
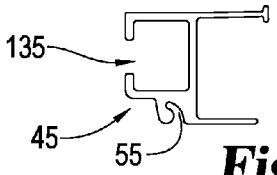
FIG. 4 is a cross-sectional view of a front embed according to one embodiment of the present disclosure.
Figure 6:
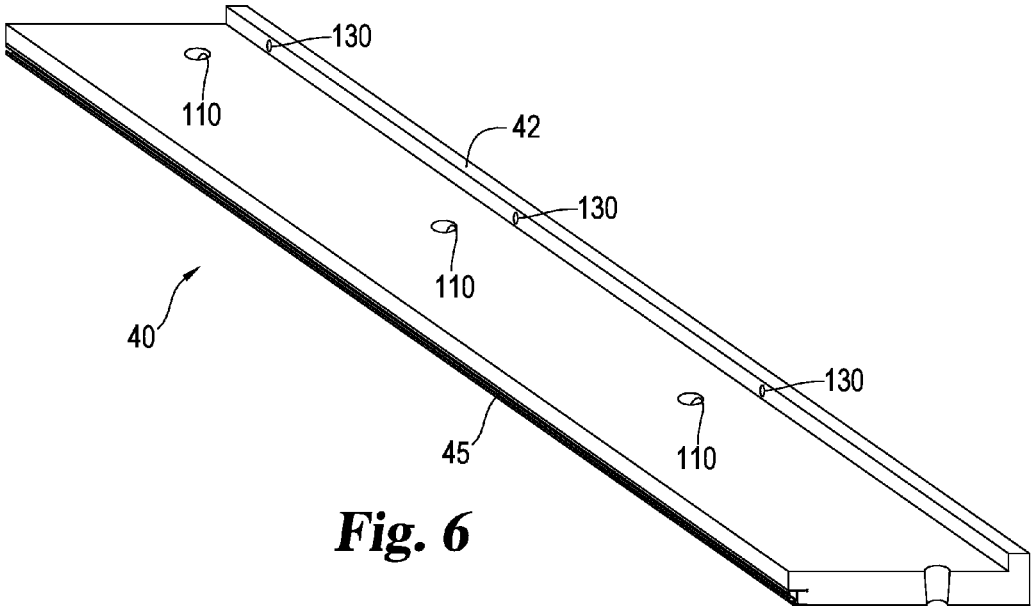
FIG. 6 is a perspective view of the concrete tread with front embed depicted in FIG. 3.
Figure 7:
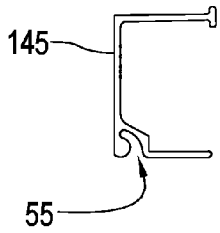
FIG. 7 is a cross-sectional view of an alternative front embed according to a further embodiment of the present disclosure.
Figure 8:
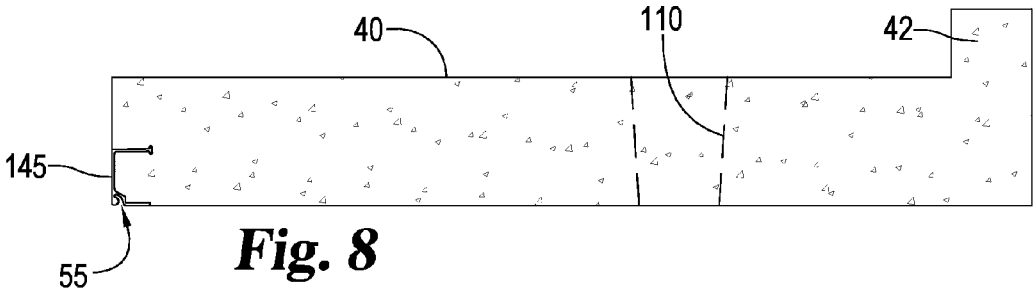
FIG. 8 is a side view of a concrete tread with the alternative front embed shown in FIG. 7.
Figure 9:
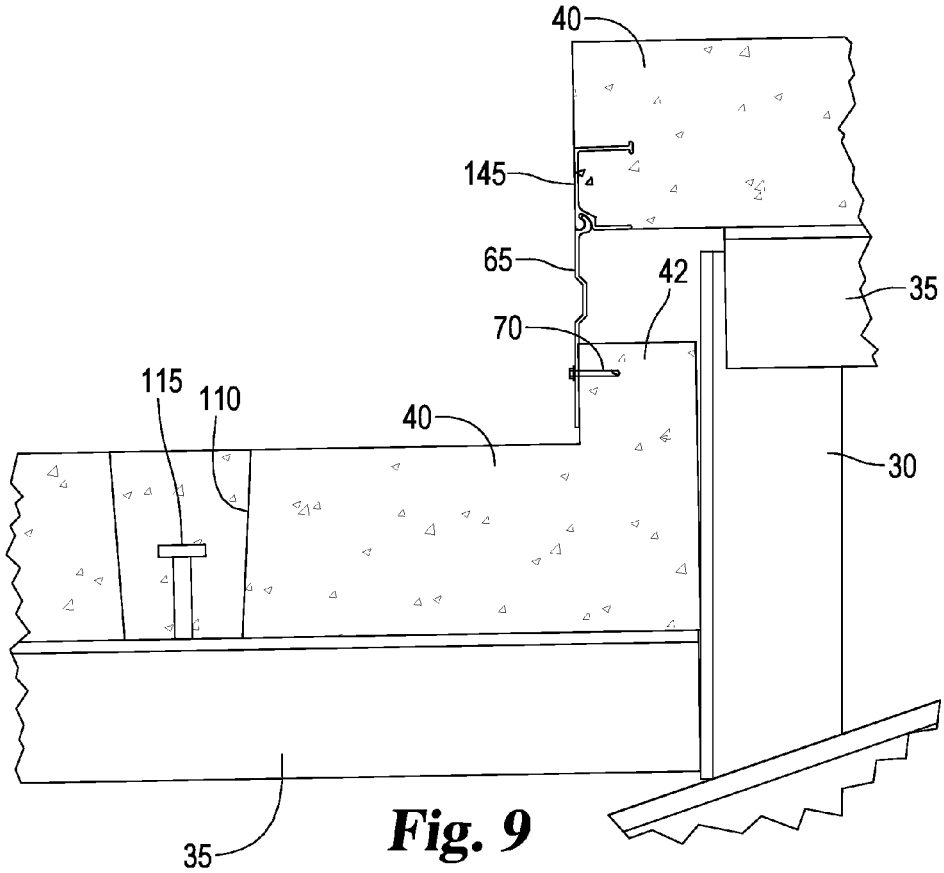
FIG. 9 is an enlarged side view of a portion of the stadium seating system incorporating the alternative front embed shown in FIG. 7.

The treads 40 may optionally include at least one front embed 45 which is embedded into the front portions, respectively, of treads 40 (FIGS. 3, 4 & 6). As seen in FIG. 6, front embed 45 extends along the entire length of tread 40, but it may also extend less than the entire length or comprise a plurality of embeds 45 spaced apart along the front portions of treads 40. FIG. 4 shows a detailed view of the cross-sectional profile of one design of the front embed 45 optionally including a channel 135. An alternative design of the front embed 45 dispensing with channel 135 is shown in FIGS. 7-9. Front embeds 45 may comprise a metallic material, such as aluminum or steel, although other types of material may also be used including, but not limited to, plastic, fiberglass and composite materials. The front embeds 45 may optionally be formed using an extrusion process and embedded into the tread 40 when the concrete comprising tread 40 is initially poured. As seen in FIGS. 3 and 6, the treads 40 also include an upwardly extending concrete lip portion 42 which is integrally formed therewith along the rear of the treads 40. The upwardly extending concrete lip portion 42 of treads 40 dispenses with the need for any rear embed such as have been known to be used in previous hybrid stadium seating understructures and can in many situations simplify on-site assembly operations and provide cost savings as well as other advantages.

Figure 5:
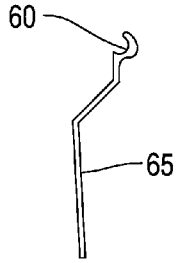
FIG. 5 is a cross-sectional view of a riser according to one embodiment of the present disclosure.

In order to provide a self-sealing continuous surface which will shed water and other debris and prevent seepage into the understructure, the front embed 45 may optionally comprise a connection device, shown in FIG. 4 as a female recess 55. The recess 55 engages a corresponding connection device, shown here as a male lip portion 60, of a non-concrete riser 65 (FIG. 5). Riser 65 serves as a cover to shield or close the space between adjacent treads 40. Riser 65 is preferably formed of a metallic material, such as aluminum or steel, although other types of material may also be used including, but not limited to, plastic, fiberglass and composite materials. As perhaps best shown in FIG. 2, once the male lip portion 60 is inserted into the recess 55, the riser 65 may optionally be attached to an upwardly extending lip portion 42 of tread 40 using a suitable fastener 70. It shall be understood that many types of conventional fasteners 70 known in the art may be used to attach the riser 65 to the upwardly extending concrete lip portion of tread 40. For example, Tapcon® concrete screws may be employed which fasten into holes drilled into the concrete lip portion 42 of treads 40 on-site during assembly. Alternatively, preformed mounting holes 130 may be formed in pre-cast treads 40 (FIG. 6) to receive concrete wedge anchors or other suitable fasteners.

Figure 2:
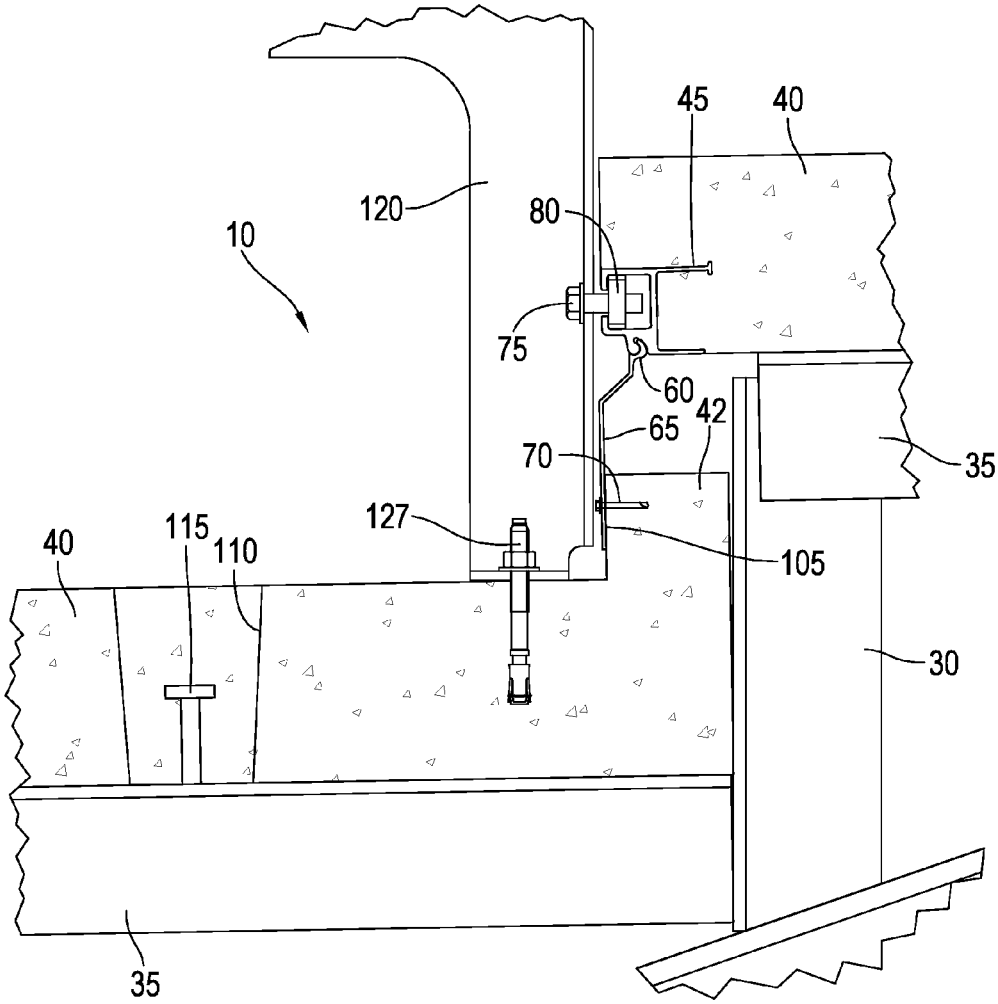
FIG. 2 is an enlarged side view of a portion of the stadium seating system depicted in FIG. 1.

When the riser 65 is attached to the upwardly extending concrete lip portion 42 of tread 40 as shown in FIG. 2, the lower portion 105 of the riser 65 will be adjacent to the forward side of the upwardly extending concrete lip portion 42 of the treads 40. This overlapping shingled arrangement allows the combination of the riser 65 and the upwardly extending concrete lip portion 42 of the treads 40 to shed water and other debris down the surfaces of the stadium seating system 10 without the need for caulking or welding where the risers 65 and lip portions 42 meet. The arrangement further allows some vertical adjustability in the mounting of the risers 65 relative to the treads 40 as the only requirement is that the riser 65 and lip portions 42 overlap enough to effectively shed water. This vertical adjustability also allows uniform thickness treads 40 to be poured in flat beds and used in multiple projects, eliminating the need for custom forms for each project. Yet another benefit of this arrangement is that it affords the ability to use it with many varying riser heights.

It shall be understood that while the illustrated embodiment depicts an arrangement wherein the upper male lip portion 60 of the risers 65 interlock with the front embed 45 of an upper adjacent tread 40, other variations on this arrangement are contemplated to be within the scope of the present disclosure. For example, the front embed 45 may simply comprise a downwardly-extending lip which overlaps the front side of the upper portion of a lower adjacent riser 65 in a shingled manner. Likewise, the lower portion of the riser 65 may comprise a connection device which interlocks with a corresponding connection device within an upwardly extending concrete lip portion 42 of a lower adjacent tread 40.

In certain embodiments, the treads 40 may include holes mounting 110. Holes 110 are preferably formed when the concrete treads 40 are poured, or alternatively cut into the treads 40 at the factory. The holes 110 allow the treads 40 to be easily mounted to the runner supports 35 from the top side of the treads 40 using any appropriate fastener known in the art. In one embodiment, studs 115 may be welded to the runner supports 35, whereby the studs 115 serve as the lower portion of a fastening device (FIG. 1). For example, a precast tread 40 may be set in place, after which time the installer can simply attach a corresponding upper fastener to each stud from above, without the need to reach under or otherwise manipulate a lower fastener below the tread 40. It shall be understood that other types of fasteners known in the art may also be inserted through the holes 110 to secure the treads 40 to the runner supports 35.

As shown in FIGS. 1 and 2, seat brackets 120 may be attached to the front embeds 45 to support bench seating panels 125. This allows the mounting of the bench seating panels 125 to be achieved without the need for labor-intensive fasteners such as concrete anchors to be installed into the treads 40 located behind the seat brackets 120. Instead, bolts 75 and nuts 80 (FIG. 2) attach the seat brackets 120 to channels 135 formed in the front embeds 45. For extra rigidity, concrete wedge anchors 127 may optionally be employed to anchor the bottom of the seat brackets 120 to the treads 40 located immediately below them.

The described embodiments provide the noise reduction, minimized vibration and deflection, and appearance of a fully concrete system, while at the same time offering the ease of installation, mounting flexibility and lower cost of a metallic system. In addition, certain embodiments of the disclosed system allow the installation of the risers 65 after the installation of the concrete treads 40 is completed. This eliminates the need to have multiple crews on the jobsite at one time and allows the metallic riser portions to be shipped to the jobsite later in the project.

The disclosed system also allows the use of a durable factory-applied finish on metallic risers 65 that is typically not available for concrete. For example, the risers 65 may be powder coated, whereas a concrete vertical surface would typically need to be painted to achieve a similar aesthetic impression, and would still lack the durability of powder coating.

FIGS. 7-9 depicts another embodiment of the stadium seating construction incorporating use of an alternative front embed 145 not having the channel 135 shown for example in the front embed of FIG. 4. As there is no channel 135 provided to allow attachment of bolts to anchor seating panels to the treads 40, other means of attachment such as for example Tapcon® concrete mounting screws 70 would need to be employed to attach the seating panels to concrete treads 40.

While the invention has been illustrated and described in detail in the drawings and foregoing description, the same is to be considered as illustrative and not restrictive in character, it being understood that only the preferred embodimens have been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A stadium seating construction system, comprising:

a tiered stadium seating support understructure;

a plurality of tiered pre-cast concrete treads mounted to the stadium seating support understructure, at least one of said treads having a) a pre-cast concrete body portion, b) a pre-cast concrete lip portion integrally formed with and extending upwardly from a rear end of the concrete body portion, and c) a non-concrete front embed embedded within a front end of the concrete body portion; and a plurality of tiered non-concrete risers, at least one of said risers arranged such that a lower portion of the riser overlaps the forward side of the upwardly extending pre-cast concrete lip portion of a lower adjacent tread of the at least one of said treads and receives therethrough a fastener attaching the riser to the upwardly extending pre-cast concrete lip portion.

2. The stadium seating construction system of claim 1, wherein said front embed having a first connection device and said at least one of said risers having an upper portion and a lower portion, the upper portion comprising a second connection device, wherein the first connection device of at least one of the plurality of treads is adapted to interlock with the second connection device of a lower adjacent one of said plurality of risers.

3. The stadium seating construction system of claim 2, wherein said upwardly extending pre-cast concrete lip portion formed with a plurality of pre-formed mounting holes through which fasteners for fastening a lower portion of the riser which overlaps with a forward side of the upwardly extending portion may be received.

4. The stadium seating construction system of claim 2, wherein said plurality of tiered pre-cast concrete treads each have only one non-concrete embed.

* * * * *